US006628917B2

(12) United States Patent
Lee

(10) Patent No.: US 6,628,917 B2
(45) Date of Patent: Sep. 30, 2003

(54) FUSING DEVICE FOR ELECTROPHOTOGRAPHIC IMAGE FORMING APPARATUS

(75) Inventor: Kyung-woo Lee, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/126,536

(22) Filed: Apr. 22, 2002

(65) Prior Publication Data

US 2003/0044204 A1 Mar. 6, 2003

(30) Foreign Application Priority Data

Sep. 6, 2001 (KR) ..... 2001-54804

(51) Int. Cl.[7] ..... G03G 15/20; F28D 11/02; F28F 5/02; H05B 1/00; H05B 11/00

(52) U.S. Cl. ..... 399/330; 165/89; 219/216

(58) Field of Search ..... 399/88, 89, 320, 399/328, 330, 333, 335; 219/216; 165/89; 430/124

(56) References Cited

U.S. PATENT DOCUMENTS 3,952,798 A * 4/1976 Jacobson et al. ..... 165/89 X
4,091,264 A * 5/1978 Sarcia ..... 165/89 X
4,172,976 A * 10/1979 Namiki et al. ..... 165/89 X
4,229,644 A * 10/1980 Namiki et al. ..... 165/89 X
4,284,875 A * 8/1981 Namiki et al. ..... 219/216
4,354,137 A * 10/1982 Martin et al.
5,426,495 A * 6/1995 Sawamura et al. ..... 165/89 X
RE36,124 E * 3/1999 Yokoyama et al. ..... 399/330
6,006,052 A * 12/1999 Kamimura et al. ..... 399/328 X
6,252,199 B1 * 6/2001 Toyota et al. ..... 219/216
6,255,632 B1 * 7/2001 Yokoyama et al. ..... 399/330 X
6,463,251 B2 * 10/2002 Kiuchi ..... 399/330

* cited by examiner

*Primary Examiner*—Sandra Brase
(74) *Attorney, Agent, or Firm*—Robert E. Bushnell, Esq.

(57) ABSTRACT

A fusing device for an electrophotographic image forming apparatus includes: a heat pipe having a tubular shape and containing a predetermined amount of working fluid, the heat pipe being hermetically sealed at both of its ends; a fusing roller surrounding the heat pipe; a heater spirally installed between the fusing roller and the heat pipe for generating heat; and a power connecting unit for transmitting external electric power to the heater. The heater includes: a resistive coil for generating heat using the electric power transmitted by the power connecting unit; an insulation layer covering the resistive coil; a metal layer surrounding the insulation layer; and leads for connecting the resistive coil to the power connecting unit at both ends of the heater. Accordingly, the fusing roller uses the heat pipe, thereby reducing warm-up time for initial operation. In addition, use of the leads acting as a heat sink secures the reliability of the heater in the fusing device

21 Claims, 9 Drawing Sheets

FUSING DEVICE FOR ELECTROPHOTOGRAPHIC IMAGE FORMING APPARATUS

CLAIM OF PRIORITY

This application makes reference to, incorporates the same herein, and claims all benefits accruing under 35 U.S.C. §119 from my application FUSING DEVICE OF ELECTROPHOTOGRAPHIC IMAGE FORMING APPARATUS filed with the Korean Industrial Property Office on Sep. 6, 2001 and there duly assigned Ser. No. 54804/2001.

BACKGROUND OF THE INVENTION

1. Technical Field

The present invention relates to a fusing device for an electrophotographic image forming apparatus and, more particularly, to a fusing device using a heat pipe to decrease power consumption and allow flash heating in an electrophotographic image forming apparatus.

2. Related Art

Electrophotographic image forming apparatuses include a fusing device for heating a sheet, to which a toner image is transferred, in order to fuse and fix the toner image in a powder state to the sheet. The fusing device includes a fusing roller for fusing and fixing toner to a sheet and a pressing roller for pressing the sheet against the fusing roller.

A fusing roller unit includes a cylindrical fusing roller and a halogen lamp installed inside the fusing roller and along its axis. A Teflon coating layer is formed on the surface of the fusing roller. The halogen lamp generates heat within the fusing roller, and the fusing roller is heated by the radiant heat emitted from the halogen lamp.

A pressing roller is disposed below the fusing roller unit and in contact with the fusing roller such that a sheet passes therebetween. The pressing roller is elastically supported by a spring so that it can make the sheet closely contact the fusing roller with a predetermined pressure when the sheet passes between the fusing roller and the pressing roller. A toner image formed on the sheet in a powder state is fused and fixed to the sheet by predetermined pressure and heat when the sheet passes between the fusing roller and the pressing roller.

A thermistor for measuring the surface temperature of the fusing roller, and a thermostat for cutting off the supply of power when the surface temperature of the fusing roller exceeds a predetermined set value, are provided at one side of the fusing roller. The thermistor measures the surface temperature of the fusing roller, and transmits an electric signal corresponding to the measured temperature to a controller (not shown) of a printer (not shown). The controller controls the quantity of electricity supplied to the halogen lamp according to the measured temperature so as to maintain the surface temperature of the fusing roller within a predetermined range. When the temperature of the fusing roller exceeds the predetermined set value because the thermistor and the controller fail to control the temperature of the fusing roller, a contact (not shown) of the thermostat opens to cut off the supply of power to the halogen lamp.

Such a fusing device using a halogen lamp as a heat source consumes a large amount of electric power. Particularly, when power is turned on, the device requires quite a long warm-up time. The warm-up time may range from several tens of seconds to several minutes. In addition, in the fusing device, since a fusing roller is heated by radiation emitted from a heat source, heat transmission is slow, and compensation for temperature deviation caused by a decrease in temperature occurring due to contact with a sheet is slow, so that it is difficult to maintain the temperature of the fusing roller constant. Moreover, since electric power must be periodically applied to the heat source in order to maintain the temperature of the fusing roller constant in a standby mode (in which the operation of the printer is in pause), unnecessary electric power is consumed.

SUMMARY OF THE INVENTION

To solve the above-described problems, it is an object of the present invention to provide a fusing device, including a power connecting unit having improved durability and reliability, and decreasing warm-up time during initial operation, or during transition from a standby mode to renewed operation, in an electrophotographic image forming apparatus.

To achieve the above object of the invention, there is provided a fusing device for an electrophotographic image forming apparatus. The fusing device includes: a heat pipe having a tubular shape and containing a predetermined amount of a working fluid, the heat pipe being hermetically sealed at both of its ends; a fusing roller surrounding the heat pipe; a heater spirally installed between the fusing roller and the heat pipe for generating heat; and a power connecting unit for transmitting external electric power to the heater. The heater includes: a resistive coil for generating heat using the electric power transmitted from the power connecting unit; an insulation layer covering the resistive coil; a metal layer surrounding the insulating layer; and leads for connecting the resistive coil to the power connecting unit at both ends of the heater.

Preferably, a longitudinal section of the heater is substantially rectangular.

Preferably, each of the leads comprises: a metal terminal having one end connected to the resistive coil, and extending outward from the bottom of each end of the heater; and a first insulator covering the bottom of each end of the heater.

Preferably, each of the leads comprises: a molybdenum thin film having one end connected to the resistive coil; a metal terminal connected to the other end of the molybdenum thin film; a second insulator enclosing the molybdenum thin film and each end portion of the heater; and a first insulator located inside a second insulator and below the bottom of each end of the heater.

Alternatively, each of the leads may comprise: a molybdenum thin film having one end connected to the resistive coil; a molybdenum wire having one end connected to the other end of the molybdenum thin film; a metal terminal connected to the other end of the molybdenum wire; a second insulator enclosing the molybdenum thin film and each end of the heater; and a first insulator located inside a second insulator and below the bottom of each end of the heater.

Alternatively, each of the leads may comprise: a metal terminal having one end connected to the resistive coil; a metal pipe enclosing each end of the heater and a portion of the metal terminal, and welded to the metal layer; and an insulator located in a space between the metal pipe and the metal terminal.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE INVENTION

Figure 1:
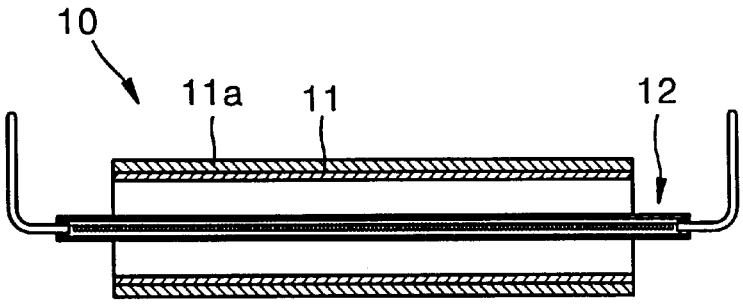
FIG. 1 is a sectional view of a fusing roller unit using a halogen lamp as a heat source.

Hereinafter, preferred embodiments of the present invention will be described in detail with reference to the attached drawings. In the drawings, the thickness of films or regions are exaggerated for clarity.

Figure 2:
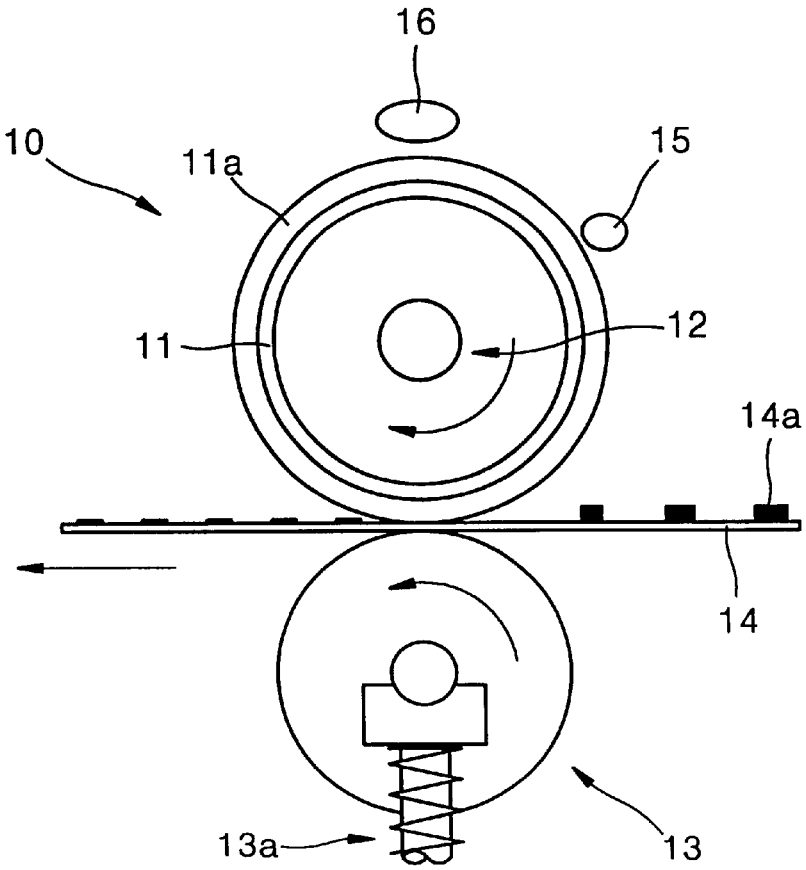
FIG. 2 is a cross-sectional view of a fusing device using the fusing roller unit of FIG. 1.

FIG. 1 is a sectional view of a fusing roller unit using a halogen lamp as a heat source. FIG. 2 is a cross-sectional view of a fusing device using the fusing roller unit of FIG. 1.

Referring to FIG. 1, a fusing roller unit 10 includes a cylindrical fusing roller 11 and a halogen lamp 12 installed inside the fusing roller 11 and along its axis. A Teflon coating layer 11*a* is formed on the surface of the fusing roller 11. The halogen lamp 12 generates heat within the fusing roller 11, and the fusing roller 11 is heated by the radiant heat emitted from the halogen lamp 12.

Referring to FIG. 2, a pressing roller 13 is disposed below the fusing roller unit 10 and in contact with the fusing roller 11 such that a sheet 14 passes therebetween. The pressing roller 13 is elastically supported by a spring 13*a* so that it makes the sheet 14 closely contact the fusing roller 11 with a predetermined pressure when the sheet 14 passes between the fusing roller 11 and the pressing roller 13. A toner image 14*a* formed on the sheet 14 in a powder state is fused and fixed to the sheet 14 by a predetermined pressure and heat when the sheet 14 passes between the fusing roller 11 and the pressing roller 13.

A thermistor 15 for measuring the surface temperature of the fusing roller 11, and a thermostat 16 for cutting off the supply of power when the surface temperature of the fusing roller 11 exceeds a predetermined set value, are provided at one side of the fusing roller 11. The thermistor 15 measures the surface temperature of the fusing roller 11, and transmits an electric signal corresponding to the measured temperature to a controller (not shown) of a printer (not shown). The controller controls the quantity of electricity supplied to the halogen lamp 12 according to the measured temperature so as to maintain the surface temperature of the fusing roller 11 within a predetermined range. When the temperature of the fusing roller 11 exceeds the predetermined set value because the thermistor 15 and the controller fail to control the temperature of the fusing roller 11, a contact (not shown) of the thermostat 16 opens to cut off the supply of power to the halogen lamp 12.

Such a fusing device, using a halogen lamp as a heat source, consumes a large amount of electric power. Particularly, when power is turned on, the device requires quite a long warm-up time. The warm-up time may range from several tens of seconds to several minutes. In addition, in the fusing device, since a fusing roller is heated by radiation emitted from a heat source, heat transmission is slow, and compensation for temperature deviation caused by a decrease in temperature occurring due to contact with a sheet is slow, so that it is difficult to maintain the temperature of the fusing roller constant. Moreover, since electric power must be periodically applied to the heat source in order to maintain the temperature of the fusing roller constant in a standby mode (in which the operation of the printer is in pause), unnecessary electric power is consumed.

Figure 3:
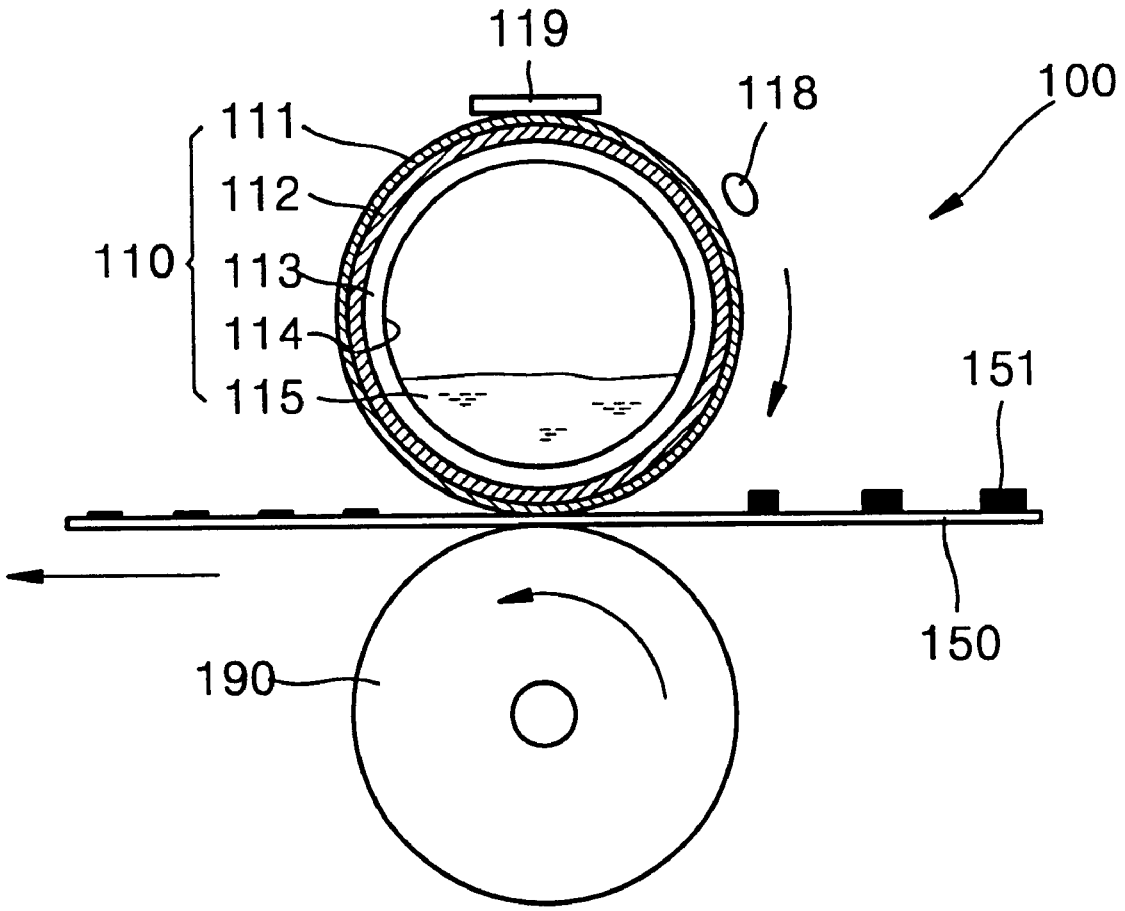
FIG. 3 is a cross-sectional view of a fusing device according to a preferred embodiment of the present invention.
Figure 4:
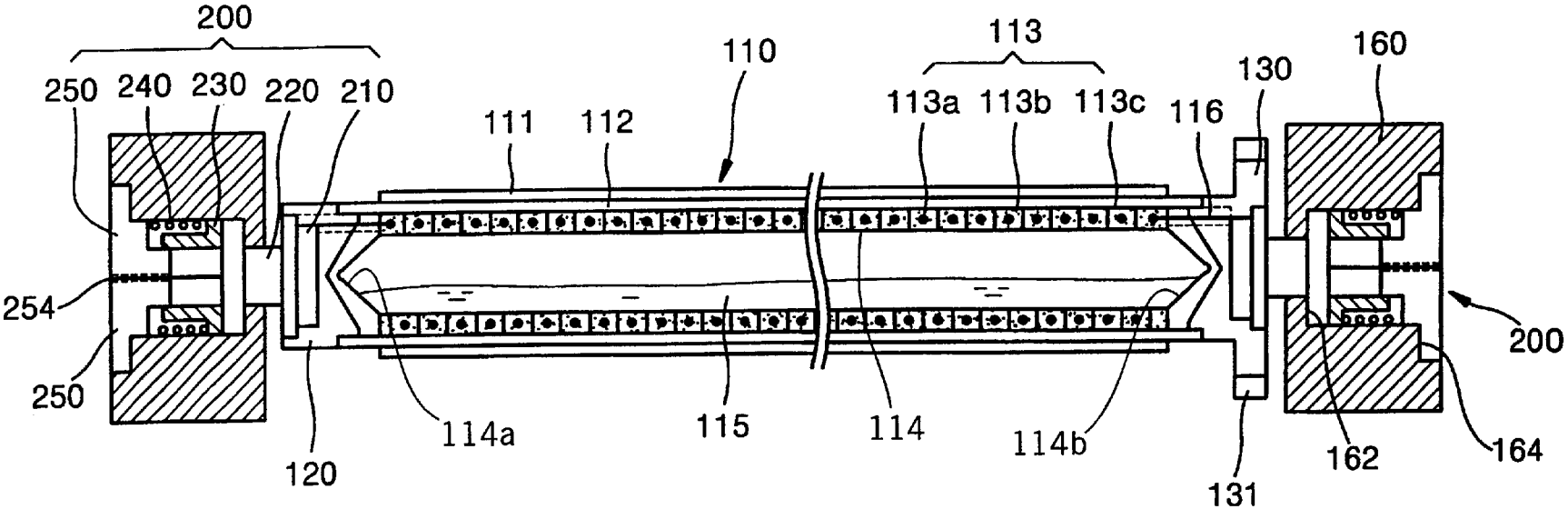
FIG. 4 is a sectional view of a fusing roller shown in FIG. 3.

FIG. 3 is a cross-sectional view of a fusing device in an electrophotographic image forming apparatus according to an embodiment of the present invention. FIG. 4 is a sectional view of a fusing roller shown in FIG. 3. Referring to FIGS. 3 and 4, a fusing device 100 in an electrophotographic image forming apparatus according to the present invention includes a fusing roller unit 110, which comprises a cylindrical fusing roller 112 rotating in the direction in which a sheet 150 is discharged (that is, clockwise), and a pressing roller 190 which rotates counterclockwise in contact with the fusing roller 112 such that the sheet 150 passes therebetween.

In the fusing roller unit 110, a toner image-releasing coating layer 111 having a Teflon coating is formed on the roller 112 to allow easy release of a toner image. The fusing roller unit 110 also includes a heater 113 which is spirally installed within the fusing roller 112, and which is supplied with electric power from an external power supply through a power connecting unit 200, and a heat pipe 114 which is installed within the heater 113, both ends of the pipe 114 being sealed hermetically to maintain a predetermined pressure. The heat pipe 114 accommodates a predetermined volume of working fluid 115. Also, the power connecting unit 200, which is installed at each end of the fusing roller 112, is connected to the external power supply so as to transmit electric power to the heater 113.

A thermistor 118 is installed above the fusing roller 112 and in contact with the toner image-releasing coating layer 111 such that it can measure the surface temperature of the fusing roller 112 and the toner image-releasing coating layer 111. Also, a thermostat 119 is installed above the fusing roller 112 so that it can cut off the supply of power in order to prevent overheating when the surface temperatures of the fusing roller 112 and the toner image-releasing coating layer 111 rapidly increase.

The heater 113 includes a resistive coil 113*a* formed of Ni—Cr for generating heat using electric power supplied from the power connecting unit 200, a magnesium oxide (MgO) layer 113*b* enclosing the resistive coil 113*a*, a metal layer 113*c* made of stainless steel and surrounding the magnesium oxide layer 113*b*, and leads 116 for connecting the resistive coil 113*a* to the power connecting unit 200 at both ends of the heater 113. The resistive coil 113*a* may be formed of Cr—Fe. A longitudinal section of the heater 113 is substantially rectangular, as shown in FIG. 4. This is for the purpose of minimizing empty space between the fusing roller 112 and the heat pipe 114 in order to increase heat transmission efficiency.

In manufacturing the fusing roller unit 110 having the above structure, the heat pipe 114 is wrapped with the heater 113 and inserted inside the fusing roller 112. Next, a pressure of 100–150 atm. is applied within the heat pipe 114 to enlarge the heat pipe 114 so that the heater 113 can closely contact the outer circumferential surface of the heat pipe 114 and the inner circumferential surface of the fusing roller 112.

The heat pipe 114 has a tube shape and is hermetically sealed at both of its ends 114*a* and 114*b*. A predetermined amount of the working fluid 115 is contained in the heat pipe 114. The working fluid 115 is vaporized due to heat generated and transmitted by the heater 113, and transmits the heat to the fusing roller 112, thereby functioning as a thermal medium which prevents temperature deviation on the surface of the fusing roller 112 and heats the entire fusing roller 112 within a short time. The working fluid 115 occupies 5–50% of the interior volume of the heat pipe 114, and preferably 5–15% of the interior volume of the heat pipe 114. If the working fluid 115 occupies 5% or less of the interior volume of the heat pipe 114, a dry-out phenomenon is very likely to occur. Accordingly, it is preferable to avoid the above case of 5% or less.

The working fluid 115 is selected depending upon the material of the heat pipe 114. For example, when the heat pipe 114 is formed of stainless steel, most working fluids known up to now, except for water, can be used as the working fluid 115. It is most preferable to use FC-40 (available from 3M) as the working fluid 115.

When the heat pipe 114 is formed of copper (Cu), most known working fluids can be used. It is most preferable to use water, i.e., distilled water. Using water or distilled water as the working fluid 115 has the advantages of low cost and prevention of environmental pollution.

The fusing roller 112 is heated by heat generated and transmitted by the heater 113, and by the heat of vaporization of the working fluid 115 contained in the heat pipe 114. Roller 112 thus fuses a powder-state toner 151 (FIG. 3) on the sheet 150, and fixes the toner 151 to the sheet 150. The fusing roller 112 is formed of stainless steel, aluminum (Al), or copper (Cu).

A first end cap 120 and a second end cap 130 are provided at respective ends of the fusing roller 112 so that both ends of the fusing roller 112 are covered by the end caps 120 and 130. The second end cap 130 has the same structure as the first end cap 120, with the exception that the second end cap 130 is provided with a gear 131 on its outer circumferential surface. The gear 131 of the second end cap 130 engages a gear (not shown) of an electric motor to allow the second end cap 130 to rotate.

Figure 5A:
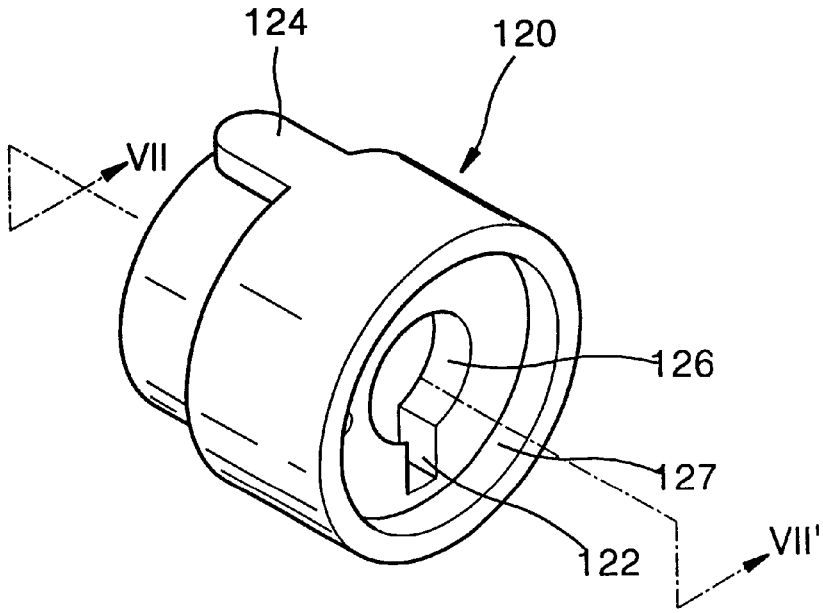
FIGS. 5A and 5B are perspective views of a first end cap shown in FIG. 4.
Figure 5B:
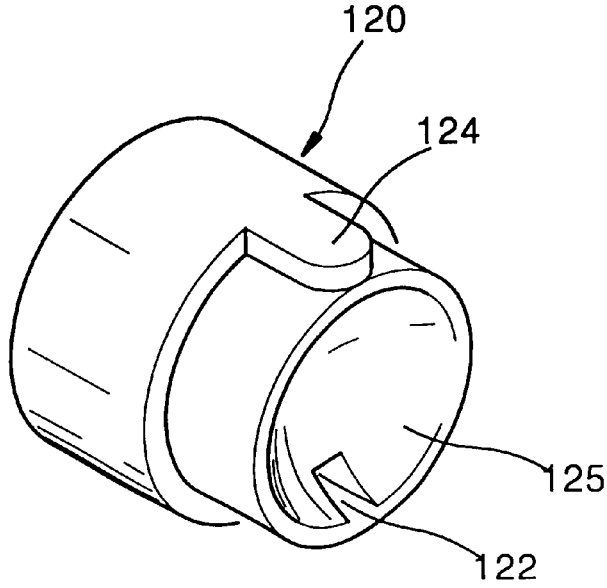
Figure 6A:
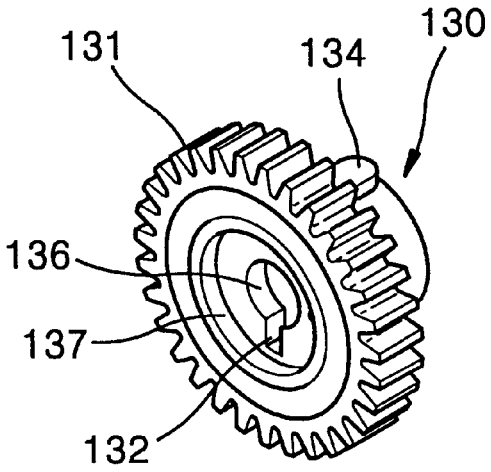
FIGS. 6A and 6B are perspective views of a second end cap shown in FIG. 4.
Figure 6B:
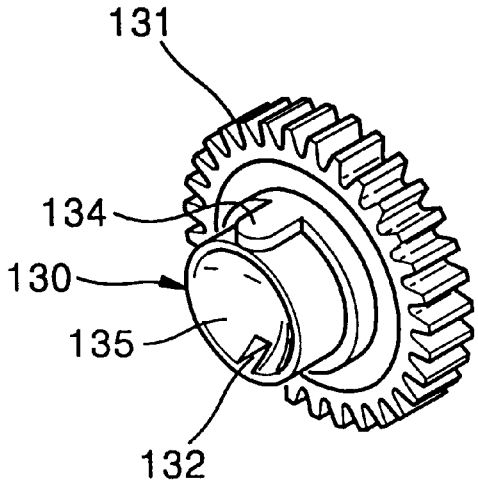
Figure 7:
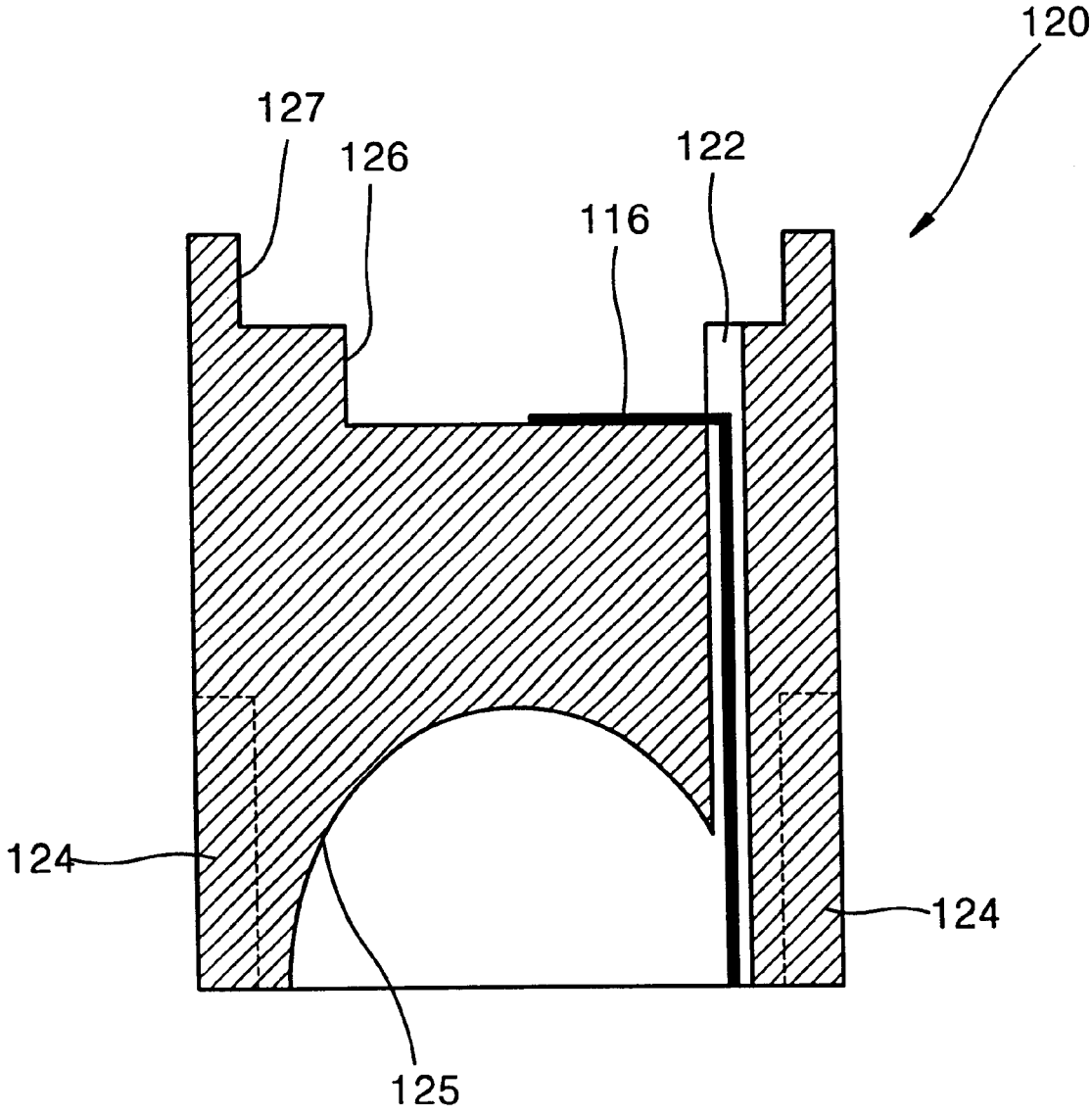
FIG. 7 is a sectional view of the first end cap of FIG. 5A, taken along line VII–VII'.

FIGS. 5A and 5B are perspective views of the first end cap 120 shown in FIG. 4. FIGS. 6A and 6B are perspective views of the second end cap 130 shown in FIG. 4. FIG. 7 is a sectional view of the first end cap 120 of FIG. 5A, taken along line VII–VII'. In FIG. 7, a lead 116 is illustrated together for clarity.

Referring to FIGS. 5A thru 7, lead holes 122 and 132 are formed in the first and second end caps 120 and 130, respectively, so that lead 116 of FIG. 7, connected to an end of the heater 113, can be introduced into each of the first and second end caps 120 and 130 in a lengthwise direction. Keys 124 and 134 are formed to protrude from the inner circumferences of the first and second end caps 120 and 130, respectively. The keys 124 and 134 engage key ways (not shown) formed at the inside surface of both ends of the fusing roller 112. Recesses 125 and 135 are formed at the centers of the first and second end caps 120 and 130, respectively, facing both ends of the heat pipe 114 such that both ends of the heat pipe 114 can be inserted into the recesses 125 and 135. Electrode ways 126 and 136 and electrode receiving portions 127 and 137 are formed in the outer centers, opposite to the recesses 125 and 135, of the first and second end caps 120 and 130, respectively, so as to allow an electrode 210 of FIG. 4 to be inserted into each of the first and second end caps 120 and 130.

Figure 8:
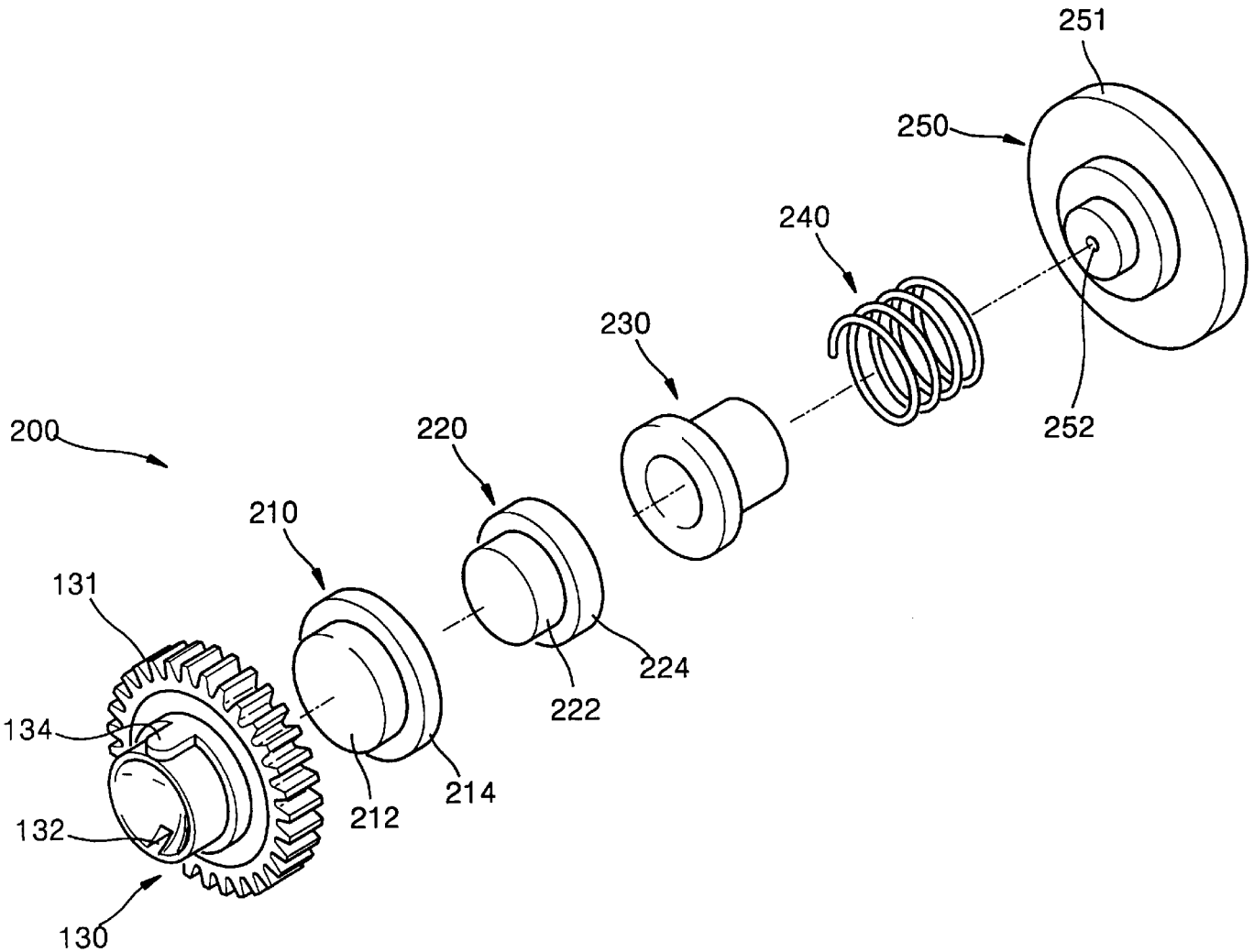
FIG. 8 is an exploded perspective view of a power connecting unit of the fusing roller of FIG. 4.

FIG. 8 is an exploded perspective view of the power connecting unit 200 connected to the second end cap 130. Referring to FIG. 8, the power connecting unit 200 is installed within a frame 160 of FIG. 4 and transmits external electric power to the heater 113. The power connecting unit 200 includes: an electrode 210 which is inserted into the electrode way 136 of FIG. 6A and the electrode receiving portion 137 of FIG. 6A; a brush 220 which is installed so as to contact the electrode 210 in a throughhole (not shown) formed in the corresponding frame 160 supporting the fusing roller 112 of FIG. 4; and an elastic unit 240 which cause the brush 220 to closely contact the electrode 210 so as to be electrically connected thereto.

The electrode 210 includes a protrusion 212 which is inserted into the electrode way 136 located at the center of the second end cap 130 (i.e., at the axis of rotation of the fusing device 110), and a flange 214 which is integrated with the protrusion 212 and inserted into the electrode receiving portion 137. The protrusion 212 of the electrode 210 is inserted into the electrode way 136 such that the lead 116, which is inserted into the lead hole 122 of FIG. 7 and bent at a right angle, can be electrically connected to the protrusion 212.

The first and second end caps 120 and 130, respectively, can be formed of resin (such as polyphenylene sulfide (PPS), polybutylene terephthalate (PBT), or nylon) which includes fillers (such as glass fiber) which is transformed only slightly, even at high temperature.

The brush 220 is connected to the electrode 210 so as to transmit external electric power, and is composed of a projection 222 and a plate 224. The projection 222 contacts the flange 214, and the plate 224 is connected to an external lead 254 of FIG. 4.

A throughhole (not shown) is formed in the frame 160. A first stopper 162 and a second stopper 164 are sequentially formed in the throughhole starting from its side nearer to the fusing roller 112. When the brush 220 is inserted into the throughhole, the first stopper 162 stops and supports the plate 224. The second stopper 164 stops and supports a flange 251 of an insulation plate 250.

The elastic unit 240 gives elasticity to a spacer 230 so that the brush 220 can closely contact the electrode 210. In addition, the elastic unit 240 buffers transformation due to repeated thermal expansion or contraction during the operation of the fusing roller 112, thus preventing the brush 220 from being disconnected from the electrode 210. Accordingly, it is preferable to use a compression spring as the elastic unit 240. The external lead 254 of FIG. 4 is connected to the brush 220 through a lead hole 252 of FIG.

8. The lead 254 may dangerously contact the elastic unit 240, provoking a spark. In order to prevent this danger from occurring and to prevent the end cap 130 from contacting the frame 160 when the brush 220 is pulled backward, a spacer 230 is provided.

The elastic unit 240 is installed inside the frame 160 by using the insulation plate 250. The insulation plate 250 supports the elastic unit 240. Accordingly, the brush 220 is installed in the throughhole (not shown) of the frame 160 first, and then the elastic unit 240 and the spacer 230 are installed. Next, the insulation plate 250 is installed to prevent the elastic unit 240 from coming off.

The operation of the fusing device having the above-described structure in an electrophotographic image forming apparatus will be described in detail with reference to the drawings.

Once electric power is supplied to the lead 116 of the heater 113 through the external lead 254, the brush 220, and the electrode 210, the electric power causes heat radiation from the resistive coil 113*a*. Some of the heat is transmitted to the fusing roller 112, and the rest is transmitted to the heat pipe 114. The working fluid 115 contained in the heat pipe 114 is vaporized by the transmitted heat. The heat of the vaporized working fluid 115 is transmitted to the fusing roller 112 through the heater 113 formed on the surface of the heat pipe 114. The fusing roller 112 receives the heat generated from the heater 113 and the heat of the working fluid 115, so that the surface temperature of the fusing roller 112 uniformly increases throughout the fusing roller 112 to a target temperature at which the toner 151 can be fused and fixed to the sheet 150.

Thereafter, in a printing mode, the powder-state toner 151 is transferred to the sheet 150, and is fused and fixed to the sheet 150 by the fusing roller 112 having a predetermined temperature while the sheet 150 passes between the fusing roller 112 and the pressing roller 190. Then, the heat of the fusing roller 112 is removed by the sheet 150 so that the working fluid 115 contained in the heat pipe 114 is liquified. Thereafter, when heat is transmitted by the heater 113, the working fluid 115 is vaporized again. Consequently, the surface temperature of the fusing roller 112 is maintained at a target temperature appropriate for fusing and fixing the toner 151 so that the printing operation can be continued.

The target temperature for normal fusing and fixing of a toner image is 160–190° C. The fusing device 100 according to the present invention reaches the target temperature within about 10 seconds. The thermistor 118 measures the surface temperature of the fusing roller 112 so as to maintain the surface temperature of the fusing roller 112 within a predetermined range for normal fusing and fixing of the toner 151. When the thermistor 118 fails to control the surface temperature and the surface temperature of the fusing roller 112 rapidly increases, the thermostat 119 mechanically cuts off the power of the power connecting unit 200 connected thereto, thereby preventing the surface temperature of the fusing roller 112 from rapidly increasing. Such a power supply operation can be controlled by ON/OFF control, a pulse width modulation method, or a proportional and integral (PI) method.

Figure 9:
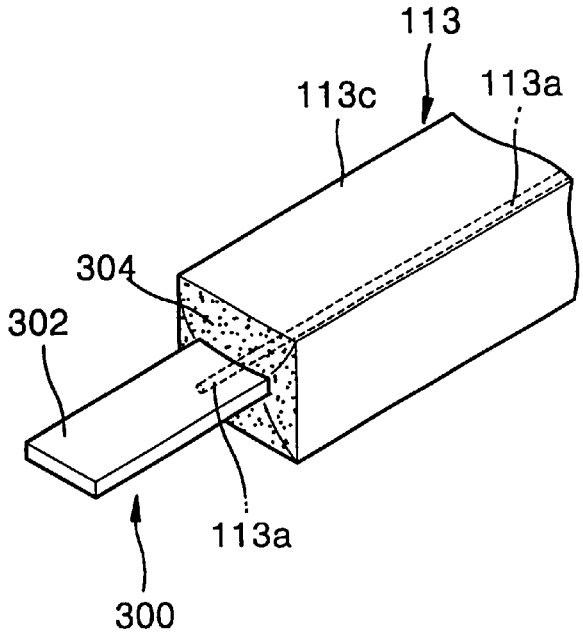
FIG. 9 is a perspective view of a first example of a lead shown in FIG. 4.

FIG. 9 is a perspective view of a first example of a lead shown in FIG. 4 according to the present invention. The elements described above are denoted by the same reference numerals as used above, and descriptions thereof will be omitted. Referring to FIG. 9, a lead 300 includes a metal terminal 302 connected to the resistive coil 113*a* at both ends of the heater 113, and a first insulator 304 covering the bottom of both ends of the heater 113. The first insulator 304 is formed of glass or zirconia.

The metal terminal 302 is connected to the electrode 210 through the throughholes 122 and 132 of the first and second end caps 120 and 130, respectively, so as to allow the resistive coil 113*a* to be electrically connected. The first insulator 304 prevents foreign substances or moisture from entering the magnesium oxide layer 113*b* (FIG. 4) and provides insulation between the metal terminal 302 and the metal layer 113*c*. The metal terminal 302 acts as a heat sink for dissipating heat of the resistive coil 113*a*, and protects the end of the resistive coil 113*a* from disconnection by heating in the air.

Figure 10:
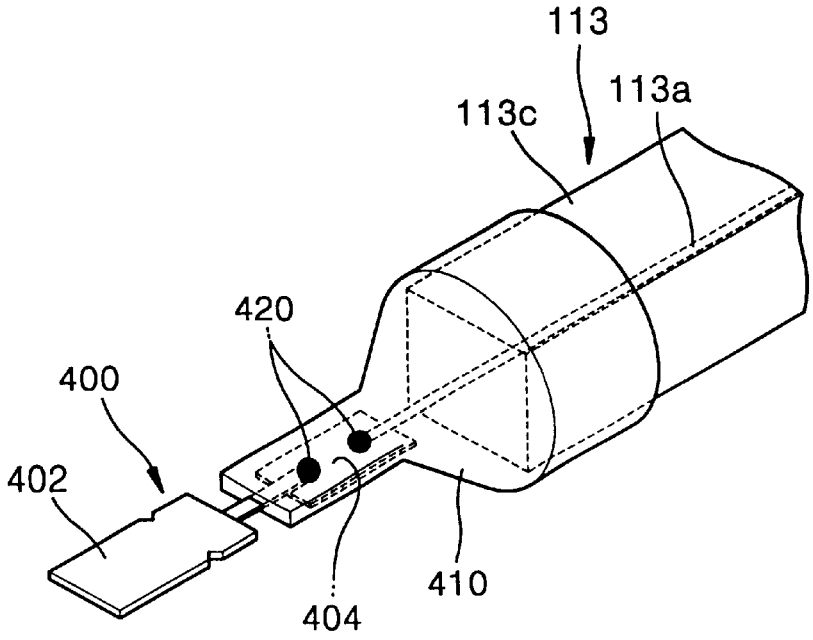
FIG. 10 is a perspective view of a second example of the lead.

FIG. 10 is a perspective view of a second example of the lead shown in FIG. 4 according to the present invention. Referring to FIG. 10, a lead 400 includes a molybdenum thin film 404 having one end welded to the resistive coil 113*a* at both ends of the heater 113, a metal terminal 402 welded to the other end of the molybdenum thin film 404, and a quartz tube 410 enclosing welding sites 420 of the molybdenum thin film 404 and each end of the heater 113. The welding sites 420 are the sites on the molybdenum thin film 404 at which the molybdenum thin film 404 is spot-welded to the resistive coil 113*a* and the metal terminal 402 using platinum (Pt) or silver (Ag). The quartz tube 410 protects both ends of the heater 113, and provides insulation between the metal terminal 402 and the metal layer 113*c*. The molybdenum thin film 404 is endurable at high temperature, and acts primarily as a heat sink for dissipating heat of the resistive coil 113*a*.

Figure 11:
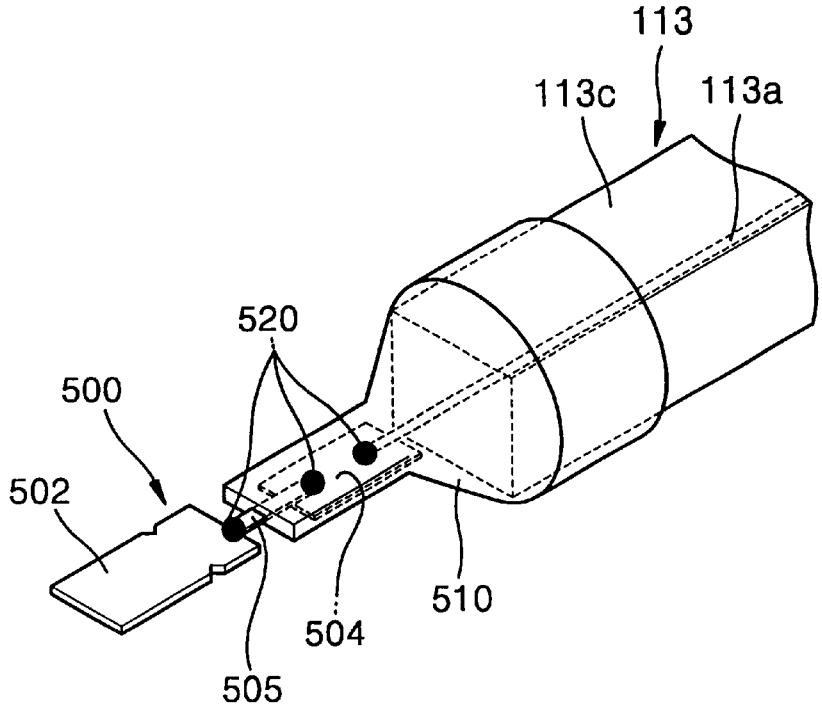
FIG. 11 is a perspective view of a third example of the lead.

FIG. 11 is a perspective view of a third example of the lead shown in FIG. 4 according to the present invention. Referring to FIG. 11, a lead 500 includes a molybdenum thin film 504 having one end welded to the resistance coil 113*a* at the end of the heater 113, a molybdenum wire 505 having one end welded to the other end of the molybdenum thin film 504, a metal terminal 502 welded to the other end of the molybdenum wire 505, and a quartz tube 510 enclosing the molybdenum thin film 504 and end of the heater 113. Reference numeral 520 denotes sites for spot-welding using Pt or Ag. The molybdenum thin film 504 and the molybdenum wire 505 are endurable at high temperature, and act primarily as a heat sink for dissipating heat of the resistive coil 113*a*.

Figure 12:
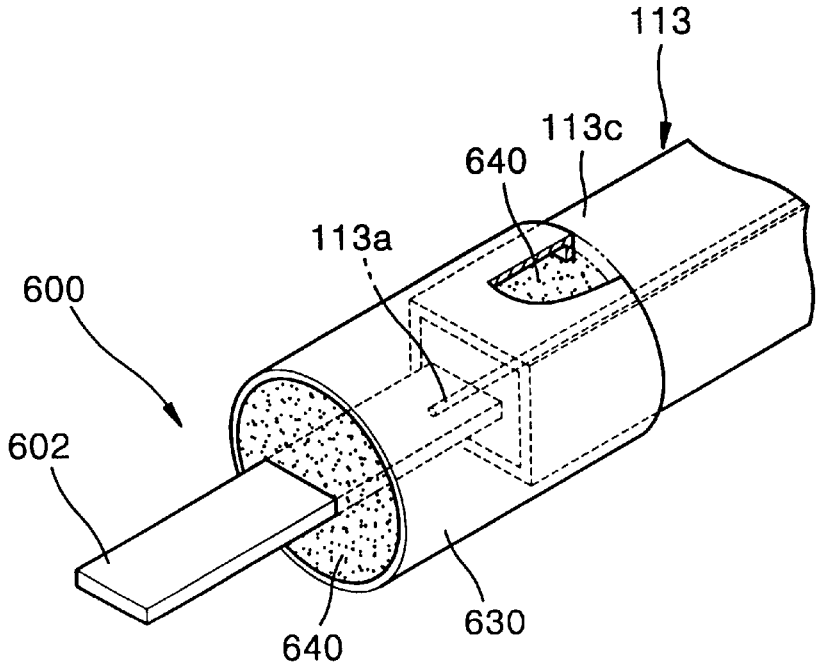
FIG. 12 is a perspective view of a fourth example of the lead.

FIG. 12 is a perspective view of a fourth example of the lead shown in FIG. 4 according to the present invention. Referring to FIG. 12, a lead 600 includes a metal terminal 602 connected to the resistive coil 113*a* at both ends of the heater 113, a metal pipe 630 enclosing each end of the heater 113 and a portion of the metal terminal 602, and welded to the metal layer 113*c*, and a zirconia filler layer 640 providing insulation between the metal pipe 630 and the metal terminal 602.

The leads 300, 400, 500, and 600 shown in FIGS. 9 thru 12 are safe from disconnection by heating in the air, thereby ensuring reliable connection between the electrode 210 and the heater 113.

As described above, the fusing device for an electrophotographic image forming apparatus according to the present invention uses a heat pipe, thereby reducing warm-up time for initial operation. In addition, use of a lead acting as a heat sink secures the reliability of the heater in the fusing roller.

Although preferred embodiments of the present invention have been described, it will be understood by those skilled in the art that the present invention should not be limited to the described preferred embodiment. Rather, various changes and modifications can be made within the spirit and scope of the present invention, as defined by the following claims.

What is claimed is:

1. A fusing device for an electrophotographic image forming apparatus, the fusing device comprising:

a heat pipe having a tubular shape and containing a predetermined amount of working fluid, the heat pipe being hermetically sealed at both ends;

a fusing roller surrounding the heat pipe;

a heater spirally installed between the fusing roller and the heat pipe for generating heat; and a power connecting unit for transmitting external electric power to the heater, wherein the heater comprises:

a resistive coil for generating heat using the electric power transmitted by the power connecting unit;

an insulation layer covering the resistive coil;

a metal layer surrounding the insulation layer; and leads for connecting the resistive coil to the power connecting unit at both ends of the heater.

2. The fusing device of claim 1, wherein a longitudinal section of the heater is substantially rectangular.

3. The fusing device of claim 1, wherein each of the leads comprises:

a metal terminal having one end connected to the resistive coil, and extending outward from each end of the heater; and an insulator covering said each end of the heater.

4. The fusing device of claim 3, wherein the insulator is formed of one of glass and zirconia.

5. The fusing device of claim 3, wherein the connection in each of the leads is achieved by one of platinum welding and silver welding.

6. The fusing device of claim 1, wherein each of the leads comprises:

a molybdenum thin film having one end connected to the resistive coil;

a metal terminal connected to another end of the molybdenum thin film; and a first insulator enclosing the molybdenum thin film and each end of the heater.

7. The fusing device of claim 6, wherein the first insulator is formed of quartz.

8. The fusing device of claim 6, wherein the connection in each of the leads is achieved by one of platinum welding and silver welding.

9. The fusing device of claim 6, further comprising a second insulator located between the first insulator and said each end of the heater.

10. The fusing device of claim 9, wherein said second insulator is formed of one of glass and zirconia.

11. The fusing device of claim 9, wherein said first insulator is formed of quartz.

12. The fusing device of claim 1, wherein each of the leads comprises:

a molybdenum thin film having one end connected to the resistive coil;

a molybdenum wire having one end connected to another end of the molybdenum thin film;

a metal terminal connected to another end of the molybdenum wire; and a first insulator enclosing the molybdenum thin film and each end of the heater.

13. The fusing device of claim 12, wherein the first insulator is formed of quartz.

14. The fusing device of claim 12, wherein the connection in each of the leads is achieved by one of platinum welding and silver welding.

15. The fusing device of claim 12, further comprising a second insulator located between the first insulator and said each end of the heater.

16. The fusing device of claim 15, wherein the second insulator is formed of one of glass and zirconia.

17. The fusing device of claim 15, wherein the first insulator is formed of quartz.

18. The fusing device of claim 1, wherein each of the leads comprises:

a metal terminal having one end connected to the resistive coil;

a metal pipe enclosing said each end of the heater and a portion of the metal terminal, said metal pipe being welded to the metal layer; and an insulator located in a space between the metal pipe and the metal terminal.

19. The fusing device of claim 18, wherein the connection in each of the leads is achieved by one of platinum welding and silver welding.

20. The fusing device of claim 18, wherein the insulator is formed of zirconia.

21. The fusing device of claim 1, wherein the insulation layer is a magnesium oxide layer, and the metal layer is an aluminum thin film.

* * * * *